United States Patent [19]

Acker et al.

[11] 4,189,015

[45] Feb. 19, 1980

[54] DRILL BITS FOR OBTAINING CORE SAMPLES

[75] Inventors: III Acker, Lenoxville, Pa.; Warren T. Acker, Wilton, Conn.

[73] Assignee: Acker Drill Company, Inc., Clarks Summit, Pa.

[21] Appl. No.: 935,357

[22] Filed: Aug. 21, 1978

[51] Int. Cl.[2] ..... E21B 9/63

[52] U.S. Cl. ..... 175/330; 175/402

[58] Field of Search ..... 175/329, 330, 58, 59, 175/60, 403, 404, 405, 215; 125/13 R

[56] References Cited

U.S. PATENT DOCUMENTS

| | | | |
|---|---|---|---|
| 2,495,400 | 1/1950 | Williams, Jr. | 175/330 |
| 2,633,682 | 4/1953 | Jackson | 175/329 UX |
| 2,838,284 | 6/1958 | Austin | 175/329 |
| 3,181,632 | 5/1965 | Raynal | 175/329 |
| 3,640,355 | 2/1972 | Lebourg | 175/329 |
| 3,692,127 | 9/1972 | Hampe et al. | 175/330 |
| 3,833,077 | 9/1974 | Lavallee | 175/329 X |

*Primary Examiner*—James A. Leppink
*Assistant Examiner*—Richard E. Favreau
*Attorney, Agent, or Firm*—LeBlanc, Nolan, SHur & Nies

[57] ABSTRACT

A drill bit used for obtaining core samples in concrete or rock formations. The drill bit comprises a cylindrical body having a generally annular-shaped cutting surface at one end and at least one waterway including an inner channel on the interior surface of the body extending to the cutting surface and an outer channel on the exterior surface of the body extending to the cutting surface at a point radially spaced from the point where the inner channel extends to the cutting surface. The waterway further includes a recessed portion on the cutting surface connecting the inner and outer channels at the points at which the channels respectively extend to the cutting surface. Such a waterway helps to wash the cutting surface of the bit so that concentration of drill cuttings on the cutting surface is minimized.

5 Claims, 4 Drawing Figures

DRILL BITS FOR OBTAINING CORE SAMPLES

BACKGROUND OF THE INVENTION

The present invention relates generally to drill bits and, more specifically, to drill bits which are used in conjunction with a core barrel to obtain core samples in concrete or rock formations.

Known drill bits used in obtaining core samples generally comprise a hollow cylindrical body including a shank portion which is provided with threads on one end for attachment of the bit to a drill string and a crown structure attached to the other end of the shank portion which provides an annular cutting surface for the bit. The crown structure is generally of a slightly larger external diameter than the shank portion so the drill string can be easily rotated while in a bore hole.

The crown structure for the drill bit may be a metal matrix composition such as tungsten carbide having numerous small diamonds embedded therein commonly known as an impregnated crown structure or, alternatively, must be a metal matrix composition having larger diamonds set in the surface of the composition known as a surface set bit.

During use of such a bit in obtaining a core sample from a bore hole, it has been the general practice to force water or other fluid such as drilling mud down the bore hole through the interior of the drill bit, allow the water to pass across the cutting surface and then return to the surface about the exterior of the hollow bit. The flow of water helps to cool the cutting surface of the bit and, more importantly, helps to flush away cuttings at the bottom of the bore hole thereby increasing the speed at which the core sample can be obtained.

To allow for the flow of water past the cutting surface, particularly with drill bits having an impregnated type crown structure, the drill bit is typically provided with one or more waterways in the area of the crown structure. Each waterway generally comprises an outer channel on the exterior surface of the drill bit body which extends to the cutting surface of the crown structure, an inner channel on the interior surface of the body extending to the same radial portion of the cutting surface, and a recessed portion in the crown structure extending radially and connecting the inner and outer channels. With such waterways, water may flow downwardly along the channel in the interior surface of the body, radially across the cutting surface in the recessed portion and then upwardly along the channel in the exterior surface of the body.

For further specifics as to the construction of conventional drill bits for obtaining core samples and their modes of operation, reference is made to the text entitled "Basic Procedures for Soil Sampling and Core Drilling" by W. L. Acker III (Acker Drill Co. Inc. 1974), particularly to pages 185 to 201 thereof.

Several problems are associated with conventional drill bits having the type of waterways as described above. During the drilling of a core sample, the cutting surface of the bit is never completely cleared of drill cuttings. These cuttings tend to concentrate on the cutting surface of the bit and sometimes actually burn into the metal matrix of the crown structure producing a scab-like appearance. Such a concentration of cuttings impedes the drilling action of the bit and, with a bit having an impregnated crown structure, prevents the even erosion and exposure of the diamonds within the metal matrix.

SUMMARY OF THE INVENTION

It is therefore an object of the present invention to provide a drill bit having improved drilling characteristics.

Another object of the present invention is to provide a drill bit having improved waterway design which tends to continuously wash the cutting surface of the bit so that the concentration of drill cuttings is minimized.

Yet a further object of the present invention is to provide an impregnated type diamond drill bit which tends to erode evenly and continuously expose new diamond particles.

Briefly the present invention in its broader aspects comprehends a drill bit comprising a cylindrical body having a generally annular shaped cutting surface at one end and at least one waterway comprising an inner channel on the interior surface of the body extending to the cutting surface, an outer channel on the exterior surface of the body extending to the cutting surface at a point radially spaced from the point where the inner channel extends to the cutting surface and a recessed portion on the cutting surface connecting the inner and outer channels at the points at which the channels respectively extend to the cutting surface.

Further objects, advantages and features of the present invention will become more fully apparent from a detailed consideration of the arrangement and construction of the constituent parts as set forth in the following specification taken together with the accompanying drawing.

DETAILED DESCRIPTION OF THE PREFERRED EMBODIMENTS

Figure 1:
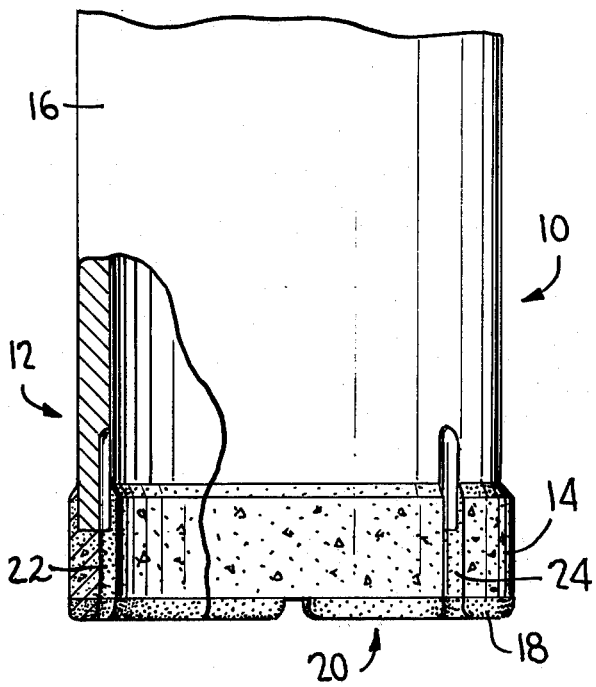
FIG. 1 is a side view, partially in section, of one embodiment of a drill bit in accordance with the present invention.
Figure 2:
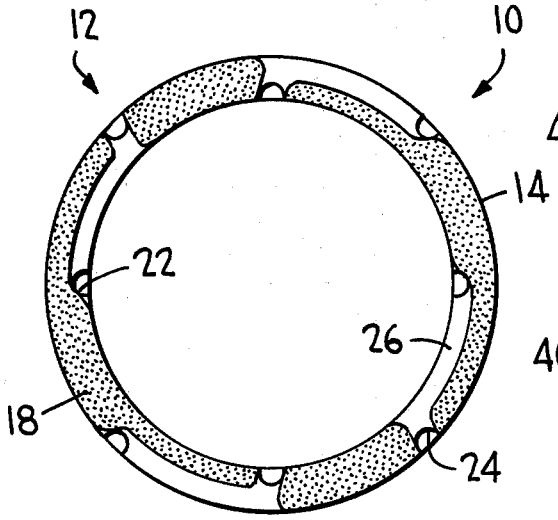
FIG. 2 is a bottom view of the drill bit as shown in FIG. 1 illustrating the cutting surface of the bit.

Referring now to FIGS. 1 and 2, drill bit 10 in accordance with the present invention comprises hollow cylindrical body 12 having a crown structure 14 and shank portion 16 attached to the top of the crown structure. Crown structure 14 has a slightly larger outer diameter and a slightly smaller inner diameter than shank portion 16. In the embodiment illustrated here, crown structure 14 is a metal matrix having diamond particles dispersed throughout. As is best shown in FIG. 2, cutting surface 18 for drill bit 10 is the generally annular end portion of crown structure 14.

Drill bit 10 further includes four waterways 20, each waterway including axially extending inner channel 22 on the interior surface of the body 12 which extends to the cutting surface 18 and axially extending outer channel 24 on the exterior surface of the body extending to the cutting surface. As is evident from FIG. 2, inner channel 22 and outer channel 24 of each waterway extend to cutting surface 18 at points radially spaced from each other. Each waterway 20 further includes recessed portion 26 in cutting surface 18 connecting inner channel 22 and outer channel 24 from the points at which the channels respectively extend to the cutting surface.

Figure 3:
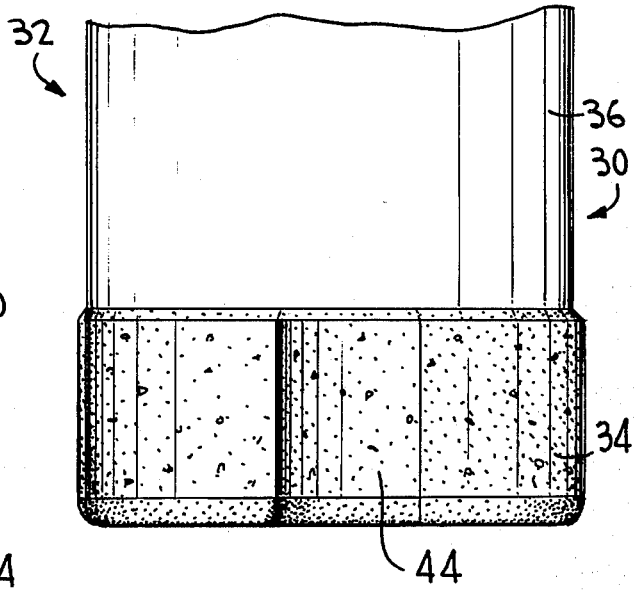
FIG. 3 is a side view of another embodiment of a drill bit in accordance with the present invention.
Figure 4:
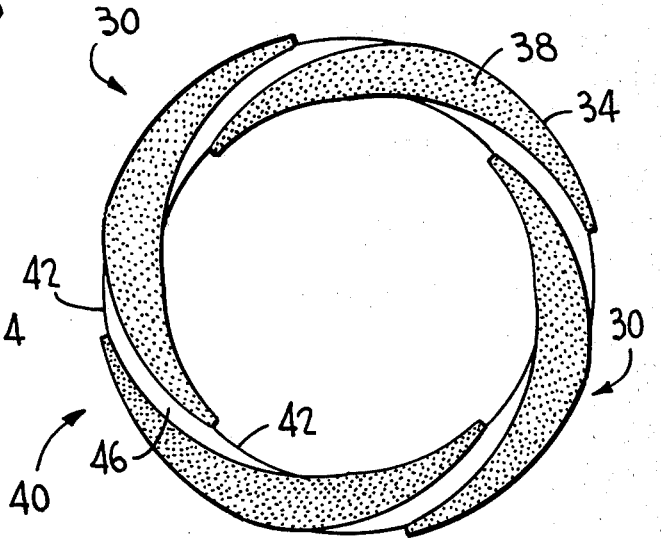
FIG. 4 is a bottom view of the drill bit as shown in FIG. 3 illustrating the cutting surface of the drill bit.

FIGS. 3 and 4 illustrate another embodiment of a drill bit in accordance with the present invention. Drill bit 30, as is best shown in FIG. 3, includes a hollow cylindrical body 32 comprising a shank portion 36 and crown structure 34 attached at one end of the shank portion. As in the previous embodiment, the generally annular end portion of the crown structure 34 is cutting surface 38 for drill bit 30.

Drill bit 30 is provided with four waterways 40, each waterway including axially extending inner channel 42 on the interior surface of body 32 which approximately extends to cutting surface 38 and axially extending outer channel 44 on the exterior of the body which approximately extends to the cutting surface at a point radially spaced from the point at which the inner channel extends to the surface. Each waterway 40 also includes recessed portion 46 on cutting surface 38, the recessed portion connecting inner channel 42 and outer channel 44 and having a generally arcuate shape when viewed along the axis of body 32.

While channels 22 and 24 and channels 42 and 44 of waterways 20 and 40 respectively have been illustrated as being parallel to the axis of the body, it should be realized that one or more of these channels may be skewed relative to the axis of the body. Furthermore, the shape, location and contour of recessed portions 26 and 46 of the cutting surface may be other shapes than those shown in FIGS. 2 and 4.

In addition, while channels 24 and 26 of drill bit 10 have a semi-circular cross-sectional shape and channels 44 and 46 of drill bit 30 have an arcuate shape, the particular cross-sectional shape of the channels for each embodiment is not believed to be critical as the inner and outer channels need only to be able to allow water or other fluid to reach and leave the cutting surface of the bit.

During operation of drill bits 10 and 30, water or other fluid is forced down the drill string and into the interior of the bit. Since the bit is cutting a core sample of approximately the same external diameter as the internal diameter of the crown structure of the drill body, the flow of water will follow inner channels to the cutting surface. As the water flows through recessed portions on the cutting surface to the outer channel, the water will flush away drill cuttings and carry them to the surface. The water carrying the drill cuttings is then forced into the outer channel due to the diameter of the crown structure being approximately the same as the bore hole diameter, and thence up the bore hole in the annular space formed between the wall of the hole and the drill bit shank and drill string.

By having the waterways constructed such that the flow of water leaves the cutting surface at a point radially spaced from the point that the water enters, several advantages in the operation of the drill bit during core sampling are realized. Among others, the flushing action of the water in removing cuttings from the cutting surface is facilitated and furthermore, the cutting surface of the bit is less likely to fracture or chip at the edge of the recessed portion since the edges are generally not transverse to the rotational motion of the bit.

While there has been shown and described what is considered to be preferred embodiments of the present invention, it will be obvious to those skilled in the art that various changes and modifications may be made therein without departing from the invention as defined in the appended claims.

We claim:

1. A core drilling bit comprising a thin-wall hollow cylindrical body having a generally annular shaped cutting surface at one end and a plurality of waterways comprising a plurality of inner channels on the interior surface of the body extending approximately to the cutting surface, a plurality of outer channels on the exterior surface of the body, and each of said outer channels extending approximately to the cutting surface at points radially offset from the points where corresponding ones of said inner channels extend to the cutting surface and a plurality of recessed portions on said cutting surface, said recessed portions extending in a substantially tangential direction along said cutting surface and connecting said inner and outer channels at the points at which said channels respectively extend to said cutting surface.

2. A drill bit according to claim 1, wherein each of said recessed portions extends along a path having a generally arcuate shape.

3. A drill bit according to claim 1, which includes at least four waterways.

4. A drill bit according to claim 1, wherein the cutting surface includes diamond particles embedded in a metal containing matrix.

5. A drill bit according to claim 1, wherein the channels extend radially along the exterior and interior surfaces of the body respectively.

* * * * *